US009149922B1

(12) United States Patent
Vazikas

(10) Patent No.: US 9,149,922 B1
(45) Date of Patent: Oct. 6, 2015

(54) TOOL STRUCTURE FOR SHAPING AN OBJECT

(76) Inventor: George Vazikas, Miami, FL (US)

( * ) Notice: Subject to any disclaimer, the term of this patent is extended or adjusted under 35 U.S.C. 154(b) by 385 days.

(21) Appl. No.: 13/595,549

(22) Filed: Aug. 27, 2012

(51) Int. Cl.
*B25D 1/00* (2006.01)
*B25D 1/16* (2006.01)

(52) U.S. Cl.
CPC ... *B25D 1/00* (2013.01); *B25D 1/16* (2013.01)

(58) Field of Classification Search
CPC ..... B25D 1/02; B25D 1/14; B25D 1/16; B25D 1/00
USPC ..... 81/23; D8/77, 78
See application file for complete search history.

(56) References Cited

U.S. PATENT DOCUMENTS

| | | | | |
|---|---|---|---|---|
| D23,169 | S | 4/1894 | Duchemin | |
| 532,008 | A * | 1/1895 | Neu | 81/27 |
| 569,161 | A * | 10/1896 | Balsley | 81/23 |
| 863,404 | A | 8/1907 | Mallet | |
| 1,591,663 | A | 7/1926 | Edwardson | |
| 2,286,859 | A | 6/1942 | Lake | |
| 2,763,172 | A | 9/1956 | Richards | |
| 3,444,908 | A | 5/1969 | Roth | |
| D297,503 | S | 9/1988 | Burton | |
| D366,604 | S | 1/1996 | Welch, Jr. | |
| 6,571,666 | B1 * | 6/2003 | Te | 81/24 |
| 6,575,481 | B1 * | 6/2003 | Davis | 280/47.17 |
| 7,168,339 | B2 * | 1/2007 | Nau | 81/23 |
| D564,323 | S | 3/2008 | Zubiaurre Alberdi et al. | |
| D565,378 | S | 4/2008 | Zubiaurre Alberdi et al. | |
| D622,123 | S | 8/2010 | Zubiaurre Alberdi et al. | |
| 7,946,010 | B1 * | 5/2011 | Myers et al. | 29/213.1 |
| 2013/0186869 | A1 * | 7/2013 | Matthews, Jr. | 219/117.1 |

FOREIGN PATENT DOCUMENTS

| | | | |
|---|---|---|---|
| CN | 202622690 U | * | 12/2012 |
| FR | 2471258 A1 | * | 6/1981 |
| WO | WO 2008070155 A2 | * | 6/2008 |

* cited by examiner

*Primary Examiner* — Lee D Wilson
*Assistant Examiner* — Joel Crandall
(74) *Attorney, Agent, or Firm* — Mark Terry

(57) ABSTRACT

A striking or shaping tool structured to size and/or otherwise shape an object such as, but not limited to a jewelry object, which is mounted on a mandrel. The tool comprises a generally hammer-like construction including a head having a base. A striking member, having a striking surface, and an alignment member are connected to the base and are cooperatively dimensioned and disposed. The striking member also includes a mandrel engaging portion comprising one or more recessed, exposed surfaces dimensioned and configured to substantially conform to an exterior surface of the mandrel. The cooperative dispositions and dimensions of a recessed exposed surface and the alignment member facilitate a concurrent, movable engagement thereof with the mandrel during a striking procedure of the striking surface on the mandrel mounted jewelry object, resulting in a predetermined operative orientation of the striking surface relative to the jewelry object, during the striking procedure.

11 Claims, 12 Drawing Sheets

TOOL STRUCTURE FOR SHAPING AN OBJECT

BACKGROUND OF THE INVENTION

1. Field of the Invention

This invention is directed to a tool, which may assume a hammer-like shape, primarily structured to size and/or shape an object, such as a jewelry object, being mounted on a mandrel. The tool includes a head having a base and a striking member and an alignment member connected to the base in cooperative relation to one another so as to concurrently and movably engage the mandrel, during a striking procedure, in a manner which disposes a striking surface of the striking member in a predetermined operative orientation relative to the object being struck, at least during the striking procedure.

2. Description of the Related Art

As commonly designed and structured, finger rings normally include a closed, fixed configuration made available to the consuming public in commonly accepted and/or standard sizes corresponding to the size of the average adult and/or child finger. However, in many circumstances it is desirable to increase the size of the ring.

Finger rings usually have a constant thickness shank portion, wherein the size of the ring may be determined by placing it on a rigid material mandrel. As is well-recognized in the jewelry profession, sizing mandrels have a generally elongated configuration with a tapered, converging exterior surface configuration extending from an inner, proximal end to an outer or distal end. Mounting on the ring over the mandrel allows it to easily pass down the length thereof until it becomes obstructed by the interior portions of the ring engaging the exterior surfaces of the mandrel corresponding to the size of the ring.

For many reasons and under various circumstances, finger rings are frequently expanded or enlarged such that they may be comfortably fitted onto a finger which is at least somewhat larger than that originally intended for the ring when manufactured. Rings are commonly expanded using a similar type mandrel as set forth above. More specifically, using a generally cooperatively configured mandrel, rings may be expanded by placing them on the mandrel and forcing the rings down along the length thereof onto a portion thereof having a greater transverse dimension. In accomplishing such enlargement, a shaping tool is used to apply pressure to the upper or outer peripheral portions of the ring. The pressure applied by the tool should be sufficient to force the ring down to the larger portions of the mandrel. However, the force applied to the ring should not be such as to cause exterior surface markings or other structural damage to the ring during the enlargement process.

Similarly, there are a number of jewelry items or objects, such as, but not limited to, bracelets, earrings, etc. which also are structured to initially have a closed, fixed and/or continuous peripheral configuration. It is also known that such additional jewelry items or objects may be enlarged or expanded in a similar or substantially equivalent manner, using an appropriately configured mandrel, as set forth above.

Therefore, common to the practice of enlarging finger rings, bracelets, and a variety of other jewelry objects is the mounting thereof on a mandrel having an exterior surface which substantially conforms to the interior peripheral configuration of the jewelry object being shaped. By way of example only, the typical finger ring sizing mandrel, of the type set forth above, may have a continuous, circular, exterior surface configuration extending along at least a majority of the length thereof. In contrast, bracelets and other jewelry items may have interior peripheral configurations which are oval, multi-sided or other known and commonly available configurations. As such, the exterior surface of the mandrel used to size and/or shape a given jewelry item must substantially correspond to the interior peripheral configuration of the object being processed.

Absent a matching of the configurations of the mandrel and the jewelry item, a distortion of the jewelry item may easily occur when the force is applied to exposed portions of the jewelry item being processed. Accordingly, the application of a pressure or force to exposed portions of the ring, bracelet or other jewelry item being sized is important. In addition to the amount of force applied to the jewelry object, the orientation of the striking surface of a shaping tool relative to the portion of the jewelry object being struck is also important.

Therefore, there is a need in the jewelry arts for a striking or shaping tool, which includes structural and operative features enabling the effective determination of a predetermined operative orientation of the striking surface of the tool, with the jewelry object being sized. The establishment of a correct or predetermined "operative orientation" facilitates the elimination or of deformation or other type damage being done to the jewelry item being struck. In light of the above, a proposed striking or sizing tool intended to overcome the disadvantages of the type set forth above should include structural features, on at least the head of the tool, which automatically accomplishes the establishment of a preferred operative orientation of the striking tool or striking surface of the tool head relative to the mandrel mounted object being shaped.

SUMMARY OF THE INVENTION

The present invention is directed to a shaping tool and/or striking tool structured to resize or shape an object, specifically including a jewelry object, which is mounted on a mandrel. As explained in greater detail hereinafter, the various jewelry objects may include, but not be limited to, finger rings, bracelets, earrings, etc. Such jewelry objects may have an at least partial common structural feature at least to the extent of having a closed, fixed and typically continuous circumferential configuration. More specifically, such jewelry objects include a generally fixed circumference or peripheral dimension, perhaps most commonly demonstrated by a finger ring.

As such, it is well recognized in the jewelry arts, that finger rings, bracelets, etc. are frequently required to be resized such as being enlarged or made smaller. A common method of enlargement comprises mounting the finger ring or other jewelry object on a mandrel and subsequently exerting a striking force on the exposed outer periphery or portion thereof. Such a striking or shaping force will force the finger ring or other jewelry object along the length of the mandrel in overlying relation to a larger transversely dimensioned portion of the mandrel. As a result, the "size" or circumferential dimension will be enlarged thereby enabling the finger ring, bracelet, etc. to be fitted or worn by a larger finger, wrists, etc. As indicated above, jewelry objects may also be made smaller, such as by removing a small piece of the circumference, connecting the new free ends together and again mounting the jewelry object on a mandrel to complete the sizing procedure.

In order to overcome the disadvantages known in the jewelry arts, the present invention is directed to a striking and/or shaping tool specifically structured to apply an appropriate striking force to the exposed portions of the any of the aforementioned jewelry objects, while mounted on the mandrel. More specifically, the structural features of the various preferred embodiments of the striking or shaping tool of the present invention facilitates the disposition of the striking surface of the present tool in a preferred "operative orientation" in order to properly distribute the striking force on the jewelry item being enlarged. As also set forth in greater detail hereinafter, the "operative orientation" of the striking surface relative to the mandrel as the jewelry object is being struck is preferably, but not exclusively, in the range between 85° and 95°. Therefore, as described herein, the sizing/striking tool of the present invention may be used to increase, decrease and/or adjust the size of a jewelry object or otherwise facilitate the reshaping thereof.

In order to deliver an appropriate force to the object, while mounted on the mandrel, the tool of the present invention may be formed into a substantially hammer-like shape. As such, the tool includes a head having a base structured to be fixedly attached to one end of a protruding, elongated handle, which along with the head defines the basic components of the hammer-like shape. The various preferred embodiments of the present invention further include the head of the tool having a striking member connected to the base, such as at one end thereof. The head of the tool also includes an alignment member connected to the base in spaced and possibly opposed relation to the striking member.

The striking member includes a striking surface, as set forth above, which engages and applies the striking force to the jewelry object being shaped or enlarged during the "striking procedure." In addition, the striking member also includes a mandrel engaging portion including one or more exposed, recessed surfaces extending along the length and recessed inwardly from the outer periphery from the striking member. The one or more exposed, recessed surfaces are dimensioned and configured to independently move along and slidably engage the exterior surface of a correspondingly dimensioned and configured mandrel as the striking force is delivered to the jewelry object being shaped.

More specifically, at least one exposed recessed surface is dimensioned and configured to substantially conform to the exterior surface of the mandrel. Such conformance will facilitate the alignment and positioning of the striking surface in the aforementioned preferred or desired "operative orientation" relative to the portion of the jewelry object being struck. As indicated and as emphasized again hereinafter, the preferred operative orientation comprises the striking surface being disposed substantially at an angle, relative to the mandrel, as the jewelry object is being struck of preferably, but not exclusively, of generally between 85° and 95°.

When used, an individual will grasp the elongated handle and position the recessed, exposed surface of the striking member into confronting engagement with the exterior surface of the mandrel. A downward or other appropriately directed force will then be delivered to the jewelry object being shaped as the head of the tool is slides along the length of the mandrel by pressure by being applied to the handle of the shaping tool. Upon contact with the jewelry object, the striking surface will deliver an appropriate force serving to force the jewelry object over the portion of the length of the mandrel having a larger transverse dimension. A repeated striking or shaping force is delivered by the tool of the present invention which will eventually cause an expansion or a "stretching" of the finger ring, bracelet, etc. thereby serving to enlarge its operative size.

Additional preferred embodiments of the present invention include the at least one recessed, exposed surface of the mandrel engaging portion at the striking member having a curved configuration along at least a majority of its length. As such, the curved configuration may have a substantially concave configuration which is dimensioned and configured to substantially conform to the outer periphery or exterior, transverse curved configuration of the mandrel on which the jewelry object is mounted. It is well recognized in the jewelry arts that numerous jewelry items or objects have square, rectangular, or other multi-sided, substantially closed configurations. Therefore, in one or more additional preferred embodiments of the present invention, the one or more recessed exposed surfaces of the mandrel engaging portion of the striking member may have a multi-sided configuration extending along at least a majority of their respective lengths. As such, the multi-sided configuration may be defined by at least two sides angularly oriented to one another so as to conform to corresponding transverse shape of the exterior surface of the mandrel on which the multi-sided jewelry object is mounted. It is again emphasized that the striking member may be cooperatively dimensioned and configured to resize and/or shape variety of different jewelry objects having a variety of different substantially curved or multisided configurations including, but not limited to, circular, oval, square, rectangular, triangular, and other circumferential configurations.

Accordingly, the at least one recessed, exposed surface of the mandrel engaging portion of the striking member may assume a variety of different configurations substantially corresponding to and accommodating different sized finger rings, bracelets, etc. Similarly, numerous, correspondingly sized and shaped mandrels are available for use. As a result, the dimension and configuration of the at least one recessed, exposed surface of the mandrel engaging portion is intended to correspond and substantially conform to the circumference of the exterior surface of the mandrel which it engages. The aforementioned sliding movement of the striking member along the length of the exterior surface of the mandrel will be maintained prior to and during the striking surface engages the jewelry object being shaped or sized. As should be apparent, the sliding engagement will be greatly facilitated by the corresponding or conforming dimension and configuration of the curved or multi-sided recessed, exposed surface of the mandrel engaging portion with the corresponding exterior surface of the mandrel.

As indicated, at least some of the preferred embodiments of the sizing and shaping tool include the striking member, and more specifically, the mandrel engaging portion thereof comprising a plurality of recessed, exposed surfaces. Each of such surfaces is dimensioned and configured to correspond and conform to the circumference or transverse exterior surfaces of specifically and/or correspondingly sized and configured mandrels on which the jewelry objects are mounted. Further, in at least one embodiment the striking member and the mandrel engaging portion associated therewith comprise a plurality of two recessed, exposed surfaces preferably, but not necessarily disposed in opposing relation to one another along the length of the outer periphery of the striking member. As such, the plurality of at least two recessed, exposed surfaces are disposed in contiguous, transverse relation to the striking surface in order to facilitate the positioning of the striking surface in the aforementioned preferred operative orientation relative to the jewelry object, as it is being struck.

Additional structural and operative features of various preferred embodiments of the present invention further include a plurality of more than two recessed, exposed surfaces of the mandrel engaging portion. More specifically, a plurality of four recessed, exposed surfaces of the mandrel engaging portion can be disposed in spaced relation to one another about the outer periphery of the striking member. In order to enhance the versatility of the striking or shaping tool of the present invention, each of the plurality of recessed, exposed surfaces of the mandrel engaging portion may be of a different size and/or different configuration so as to correspond to the dimension and configuration of the exterior surface of differently sized mandrels. This will eliminate or significantly reduce the necessity to change tools when operating on jewelry objects of different sizes and being associated with correspondingly sized and configured mandrels.

Therefore, one or more preferred embodiment of the present tool includes the striking member, having a plurality of recessed, exposed surfaces, being adjustably connected to the base. Such an adjustable connection allows for the selective positioning of any one of the plurality recessed, exposed surfaces having the intended dimension and configuration corresponding to a specifically sized and configured mandrel in an operative position. As typically structured, the adjustable striking member may be selectively rotated such that the desired or intended recessed, exposed surface of the mandrel engaging portion is disposed in an operative position to facilitate its sliding engagement with the exterior surface of the mandrel in which the jewelry object being shaped is mounted.

As set for the above, many of the preferred embodiments of the present invention include the head of the tool also comprising an alignment member. The alignment member is connected to the base in spaced and possibly opposed relation to the striking member. In one preferred embodiment, the striking member and the alignment member are disposed at opposite ends of the base and thereby define opposite ends of the head of the tool. If each embodiment incorporating the aforementioned alignment member it is correspondingly dimensioned with the striking member and more specifically, the one or more recessed, exposed surfaces defining the mandrel engaging portion thereof. As such, both the outer peripheral surface of the alignment member and the operatively positioned one of a possible plurality of recessed, exposed surfaces are disposed to concurrently engage and slide along the length of the mandrel on which the jewelry object being sized is mounted. The cooperative and correspondingly configured alignment member and recessed, exposed surfaces of the mandrel engaging portion thereby collectively serve to further assure that the striking face of the striking member is disposed in the aforementioned "operative orientation" as it strikes the jewelry object being shaped. As also set forth above, the preferred operative orientation of the striking face, relative to the mandrel, as the jewelry object is being struck of preferably, but not exclusively, between 85° and 95°.

The alignment member may be removably and/or adjustably connected to the base of the head of the tool in order to assure that the outer peripheral surface of the alignment member cooperatively corresponds to the selected one of the possible plurality of recessed, exposed surfaces of the mandrel engaging portion. Due to the fact that both the outer periphery of the alignment member and the interior recessed, exposed surface of the mandrel engaging portion are both concurrently disposed in sliding, confronting engagement with the mandrel, the preferred, operative orientation of the striking face, relative to the jewelry object being shaped will be assured.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
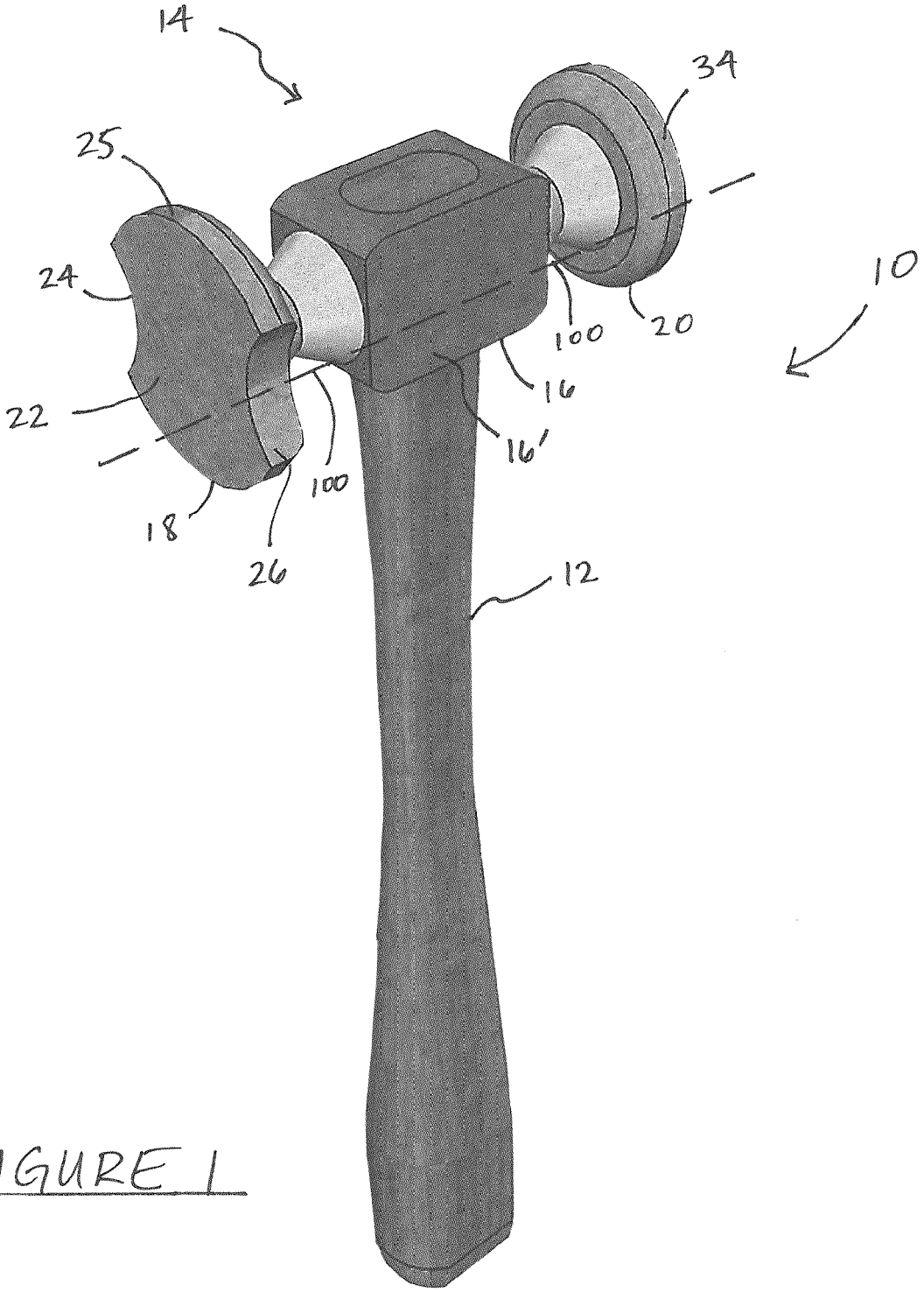
FIG. 1 is a perspective view of a shaping or striking tool of the present invention.

As represented in the accompanying drawings, the present invention is directed to a shaping tool or striking tool generally indicated as 10, which may assume a structure and overall shape generally similar to a hammer. As such, the striking or shaping tool 10 may also be generally referred to as "jeweler's hammer" in that it is primarily, but not exclusively, structured to resize or otherwise shape various jewelry items or objects. Such jewelry items may include, but are not limited to, finger rings, bracelets, earrings, bangles and other jewelry objects of the type having a continuous, closed configuration and of a fixed size. It is well known in the jewelry arts, that jewelry objects having a fixed size are frequently required to be increased, decreased or otherwise reshaped so as to selectively vary the size and/or shape thereof. In accomplishing enlargement, the rings, bracelets, etc. are fitted on an appropriately configured and dimensioned mandrel and forced along the length thereof onto a portion of the mandrel having an enlarged diameter or transverse dimension. As a result, the jewelry object will be appropriately "stretched" and thereby increased in size at least to a minimal, acceptable degree. Therefore, while the operation of the striking or shaping tool is primarily described herein with regard to increasing the size of a jewelry object, the versatility of the present invention is such that it can be used, in substantially the described manner, for the increasing, decreasing and/or other reshaping or resizing of a variety of different jewelry objects of different sizes and dimensions.

Accordingly, the shaping or striking tool 10 of the present invention is operative to effectively apply forces to a jewelry object mounted on a mandrel so as to force or shape it into a preferred size or shape as desired. In more specific terms, the shaping tool 10 of the embodiment of FIGS. 1-3 includes an elongated handle 12 and a tool head generally indicated as 14. The tool head includes a base 16 and a striking member 18 attached to the base 16. In addition, an alignment member 20 is also attached to the base 16 in spaced and/or opposing relation to the striking member 18 and may be disposed to define opposite ends of the head 14.

The striking member 18 includes a striking surface 22 and a mandrel engaging portion comprising at least one but possibly a plurality of exposed surfaces 24. Each of the one or more exposed surfaces 24 extends along the length of the perimeter 25 of the striking member 18 and is recessed inwardly from the outer periphery 25, as represented. Further of the striking surface 22 of the striking member 18 is disposed in transverse, substantially contiguous relation to the mandrel mounted object being resized. Dependent on which embodiment of the tool 10 is utilized, each of a plurality of recessed, exposed surfaces 24 may be of a common dimension and configuration or may differ in dimension and configuration. In either case, each of the recessed, exposed surfaces 24 are specifically dimensioned and configured to conform to the exterior of a mandrel 30, in the manner represented in FIG. 3. More specifically, each of the disposed, recessed surfaces 24 is dimensioned and configured to substantially conform to the circumference or exterior surface 32 which it engages during the "striking procedure" used to shape the ring, bracelet or other jewelry objects being resized.

Moreover, the substantial conformance between the exposed, interior, recessed surface or surfaces 24 and the exterior surface 32 of the correspondingly sized mandrel 30 facilitates the disposition of the striking surface 22 in a preferred and effective "operative orientation" relative to the portion of the jewelry object being struck during the striking procedure. Therefore, in use the striking member 18 moves, such as by sliding, along the length of the mandrel 30 while the recessed, exposed surface 24 continuously and movably engage the exterior surface 32 of the correspondingly dimensioned and configured mandrel 30 as a striking and shaping force is delivered to the jewelry object 150 mounted on the mandrel 30. Such a preferred operative orientation of the striking surface 22, relative to the mandrel, as the jewelry object 150 and the surface thereof 152 is being struck is preferably, but not exclusively, generally between 85° and 95°, as represented as 200 in FIG. 3A. As a result, the striking surface 22 located immediately adjacent and/or contiguously but transversely to the exposed and recessed surface 24 will engage the surface 152 of the object being struck, along substantially the entire length of that portion of the striking surface 22 or at least along a majority of the length thereof during the striking procedure. Moreover, the striking force will be delivered to the surface 152 on a more evenly distributed basis, in that a "longer" portion of the surface 152 being struck will absorb the striking force. Therefore, there will be less of a tendency to damage the jewelry object 150 during the striking procedure.

As indicated, the preference of maintaining the striking surface 22 within the aforementioned angular, "operative orientation" relative to the jewelry object being struck facilitates the delivery of a force in a manner which significantly reduces the possibility of inadvertently deforming or otherwise damaging the jewelry object being struck by the striking member 18. Therefore, the aforementioned "striking procedure" includes the sliding movement of the striking member 18 along the length of the exterior surface 32 of the mandrel 30, while the recessed exposed surface 24 of the mandrel engaging portion conforms to the transverse dimension or circumference of the exterior surface 32 of the mandrel 30. Repeated striking forces are delivered to the jewelry object along exposed portions thereof and serve to force the jewelry object along the length of the mandrel 30 onto a portion thereof having a larger diameter or transverse dimension. In turn and as set forth above this will increase the overall size of the object by stretching the circumferential dimension and/or diameter thereby increasing the effective size thereof.

The importance of disposing the striking surface 22 in the proper and preferred "operative orientation" should be apparent. Accordingly, the tool head 14 further includes the aforementioned alignment member 20 to better accomplish that the "operative orientation" of the striking surface 22 being maintained. More specifically, the alignment member 20 includes an exterior periphery 34 extending about the entire or at least a portion of the outer circumference of the alignment member 20. Moreover, the disposition, dimension, and configuration of the alignment member 20 and in particular a corresponding portion of the periphery 34 is disposed in a substantially aligned relation with the recessed, exposed surface 24 of the mandrel engaging portion of the striking member 18. This alignment is schematically represented as 100 in the accompanying Figures and is provided to further indicate, at least on a schematic basis, that both the selected and operatively positioned exposed surface 24 and the aligned portion of the outer periphery 34 of the alignment member 20 both concurrently engage the exterior surface 32 of the correspondingly dimensioned and configured mandrel 30, during the striking procedure.

In more specific terms, the striking procedure will comprise the exposed, recessed interior surface 24 and an aligned portion of the outer periphery or perimeter 34 concurrently engaging and sliding along the length of the exterior surface 32 until the striking surface 22 delivers the striking force to the jewelry object mounted on the mandrel 30. In contrast, the corresponding portion of the base, as at 16', will have a sufficiently reduced transverse dimension so as to allow alignment 100 and concurrent, sliding engagement of both the exposed, recessed surface 24 and the aligned outer periphery 34 of the alignment member 20.

Figure 2:
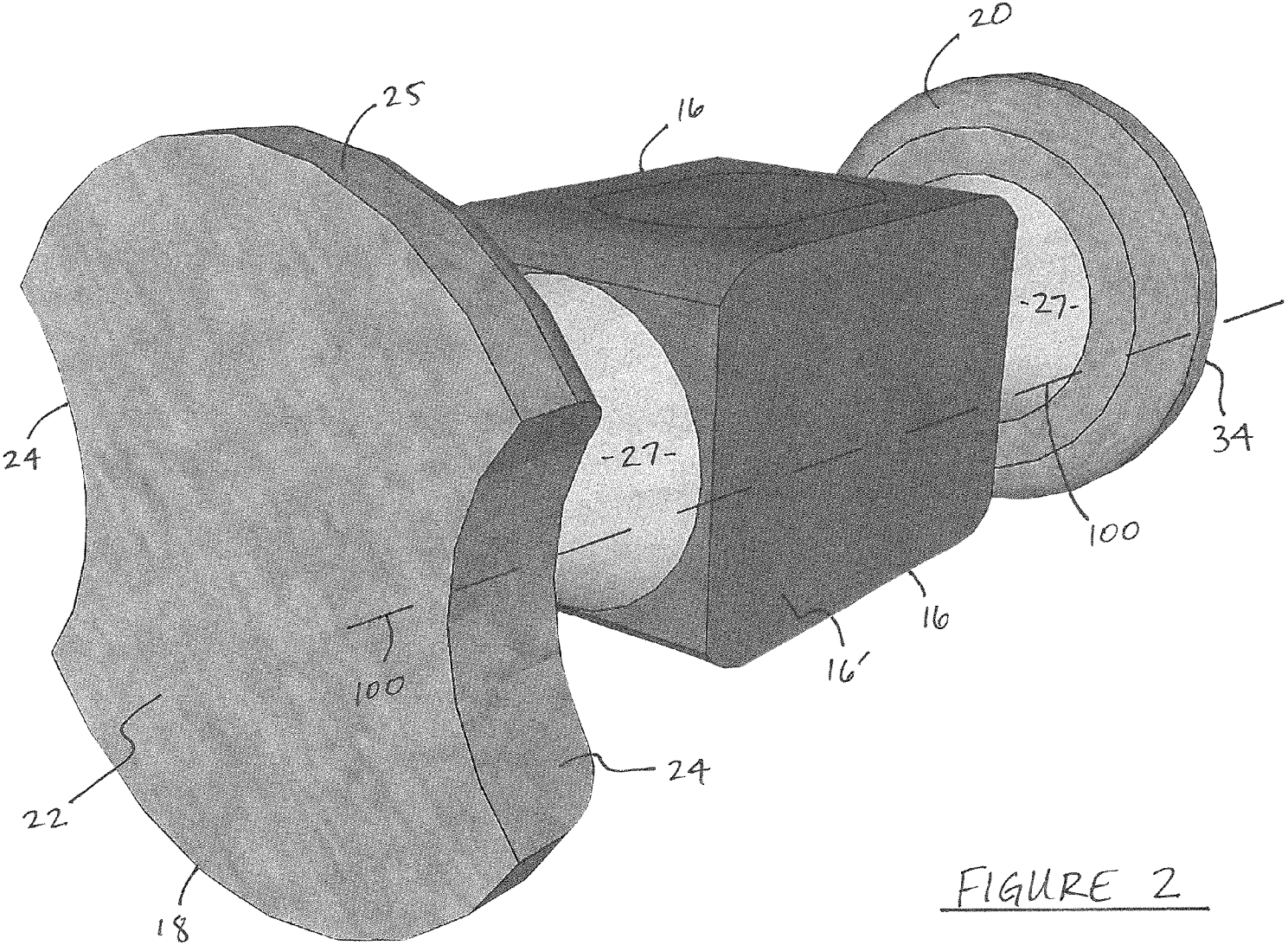
FIG. 2 is a perspective view of the head portion of the embodiment of FIG. 1.
Figure 3:
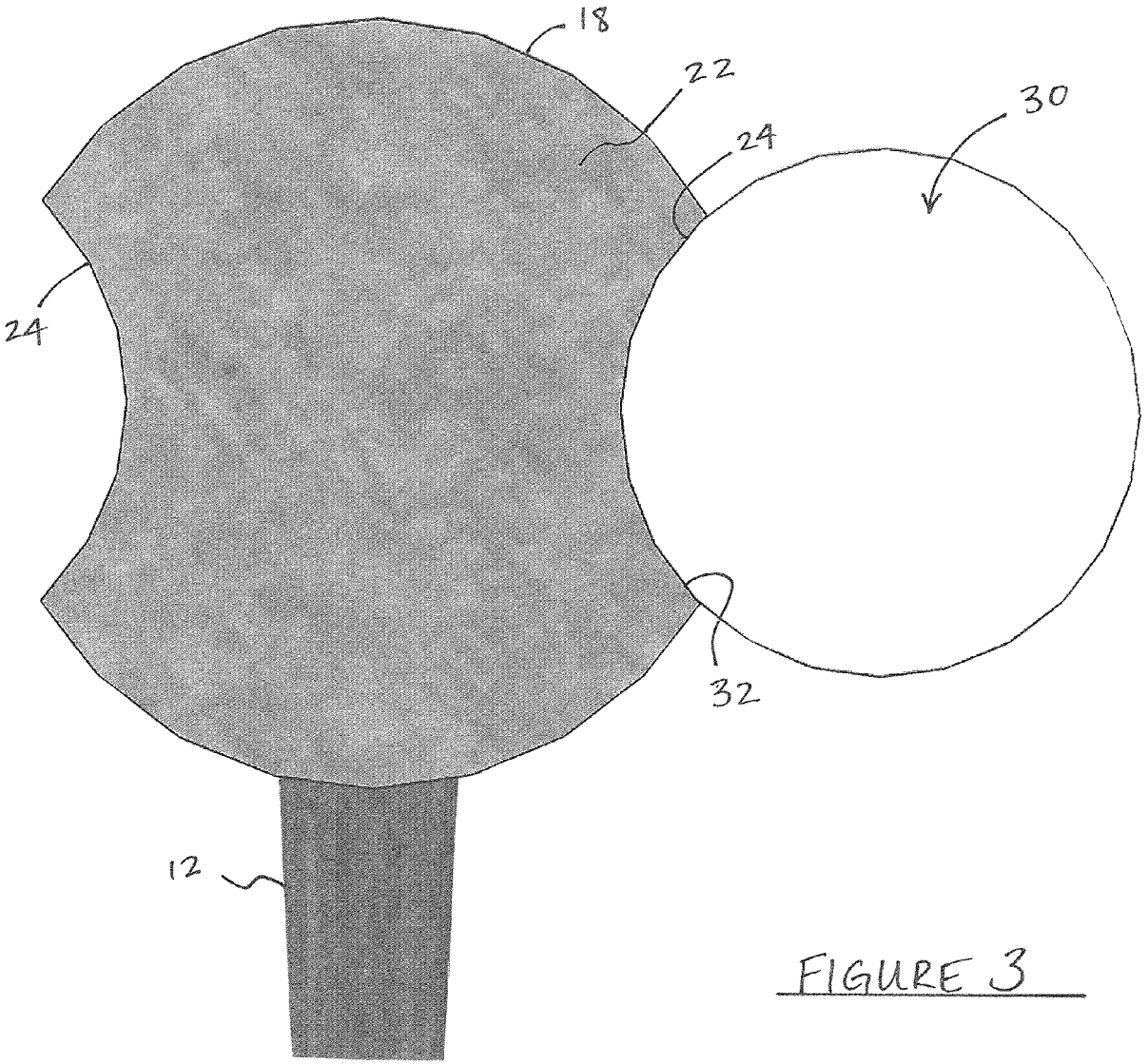
FIG. 3 is a front schematic representation of a portion of the head of the embodiment of FIGS. 1 and 2 in engaging relation with a mandrel.

As explained in greater detail hereinafter, with regard to FIG. 11, the embodiments of FIGS. 1-3, as well as the remaining preferred embodiments of the present invention, both the striking member 18 and alignment member 20 may be removably and/or fixedly connected to the base 16. When removably connected, either or both the striking member 18 and the alignment member 20 may be removed from the base 16 and replaced by a striking member 18 and/or alignment member 20 of different dimensions and configurations so as to correspond to one another a mandrel 30 of a different but corresponding dimension and configuration. As indicated, the dimension and configuration of the mandrel 30 is at least dependent on the size and configuration of the jewelry object being shaped. Also, the opposing plurality of two exposed, recessed surfaces 24 of the mandrel engaging portion may be of the same size or different sizes. When the opposed recessed surfaces 24 are the same size, the tool 10 can be easily used by either right or left handed individuals. In contrast, when the exposed, recessed surfaces 24 are of different sizes, it may be preferred that the striking member 18 may be adjustably connected to the base 16 as more specifically described with reference to the embodiment of FIG. 10.

As should be apparent, it is important when performing the aforementioned striking procedure that the jewelry object being shaped or resized is not damaged by deformation, marking, etc. Accordingly, the striking member 18 and in particular, the striking surface 32 may be formed from a variety of different material such as, but not limited to, various types of plastic including acrylics, PVC or other materials within the plastic category. Such materials are structured to at least partially reduce the striking force and the possibility of damage being done to the jewelry object mounted on the mandrel 30 when the striking force is delivered thereto by the striking surface 22. In addition, the striking member 18 and/or the striking surface 22 may also be formed of a metallic material such as brass, bronze, etc. can also facilitate or enhance performance of the striking procedure on the jewelry object without causing inadvertent damage thereto.

Figure 4:
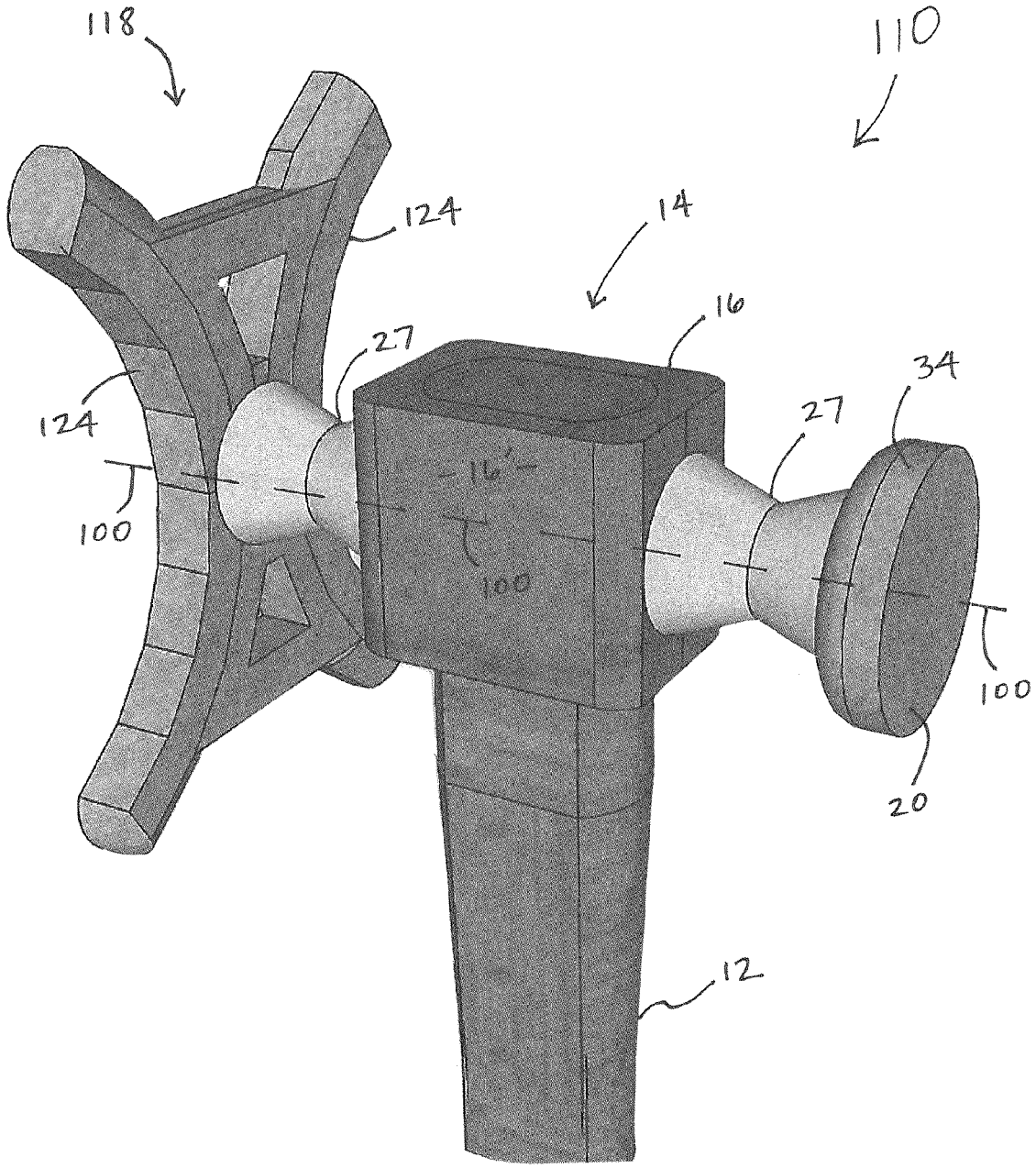
FIG. 4 is yet another embodiment of the tool of the present invention, wherein the head portion thereof is used to strike and shape larger jewelry objects, such as bracelets.
Figure 5:
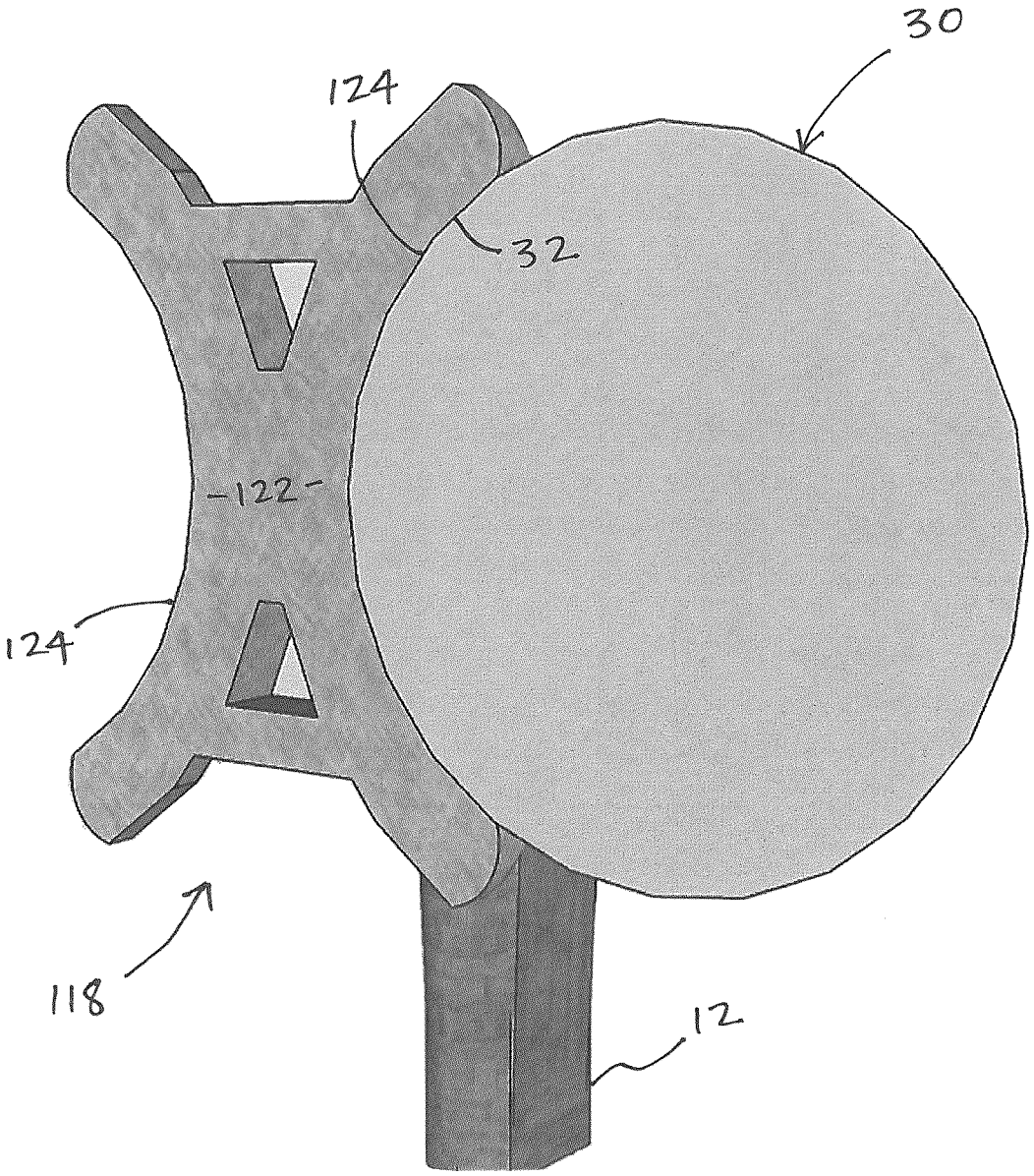
FIG. 5 is a perspective schematic view of the embodiment of FIG. 4, wherein a portion of the head is operatively engaged with a correspondingly dimensioned mandrel.

Yet another preferred embodiment of the present invention is represented in FIGS. 4 and 5, as indicated above, the size of the exposed, recessed surfaces 124 defining the mandrel engaging portion of the striking member 118 may vary in size. FIGS. 4 and 5 represent a significantly larger striking member 118 which is more suitably configured and dimensioned to accommodate the shaping or resizing of bracelets or jewelry objects larger than a finger ring. However, the basic structural and operative features of the tool 14 of the embodiment of FIGS. 4 and 5 are the same. More specifically, each of the disposed plurality of two exposed, recessed surfaces 124 have a substantially curved configuration extending along at least a majority of its length. As represented in FIG. 5, the longitudinal dimension and configuration of each of the recesses 124 substantially corresponds to the transverse dimension and/or circumference of the exterior surface 32 of the mandrel 30 which the striking member 118 engages. As a result, the striking surface 122 will be disposed in the preferred and intended "operative orientation" relative to the jewelry object being struck while mounted on a correspondingly configured and dimensioned mandrel 30.

In order to further assure proper alignment of the striking surface 122 with the jewelry object being resized, the alignment member 20 is also correspondingly disposed and configured to the one or more exposed, recessed surfaces 124 as well as the striking member 118. As such, both the aligned portions of the outer periphery 34 and the recessed, exposed interior surface 124 concurrently and slidingly engage the exterior surface 32 of the correspondingly dimensioned and configured mandrel 30 during the striking procedure of the jewelry object mounted on the mandrel 30. Again, for purposes of clarity, the aligned, concurrent movable engagement of the periphery 34 of the alignment member 20 and the exposed, recessed surface 124 of the mandrel engaging portion of the striking member 118 is schematically represented at 100.

Figure 7:
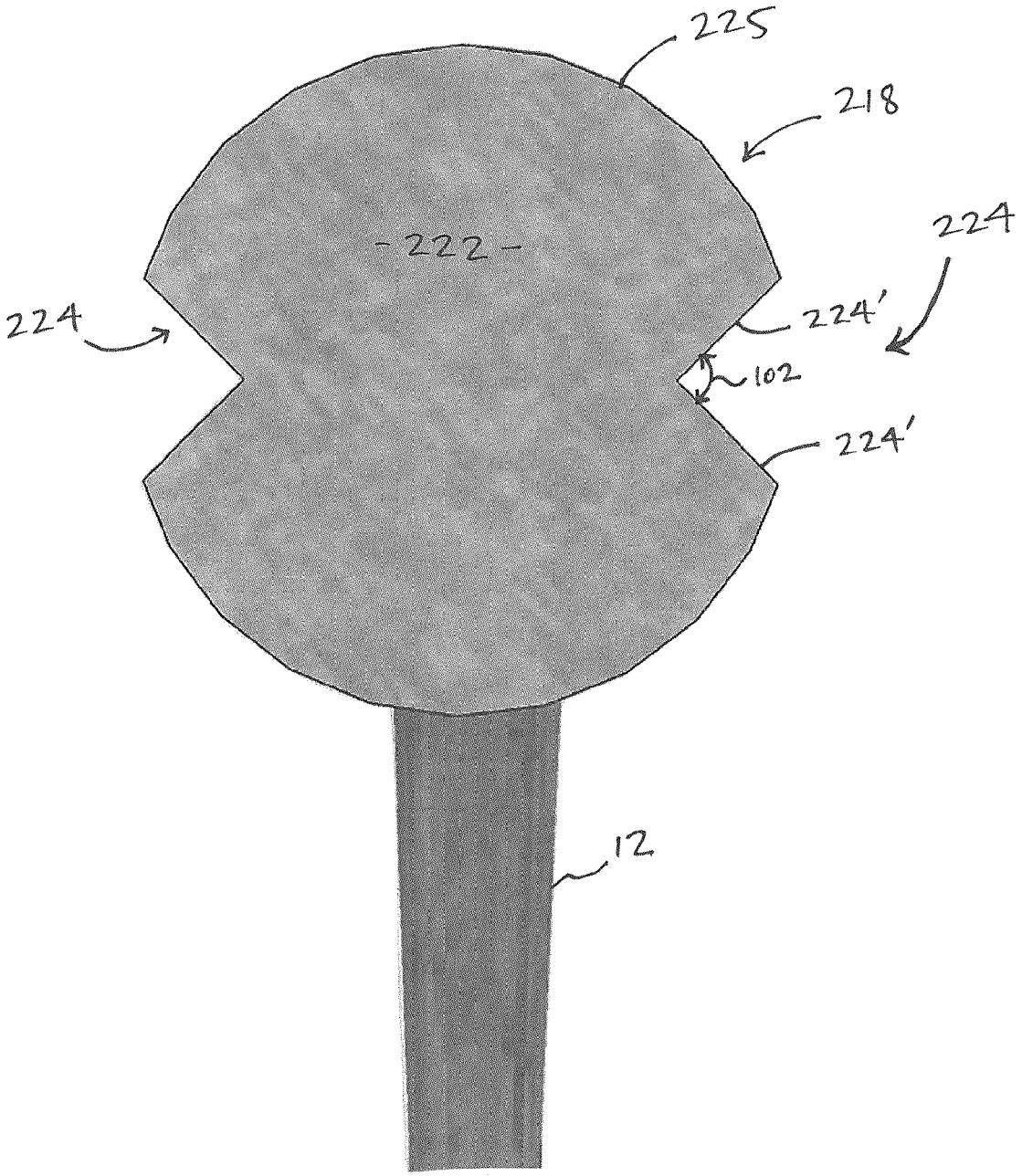
FIG. 7 is a front schematic representation of the embodiment of FIG. 6.
Figure 8:
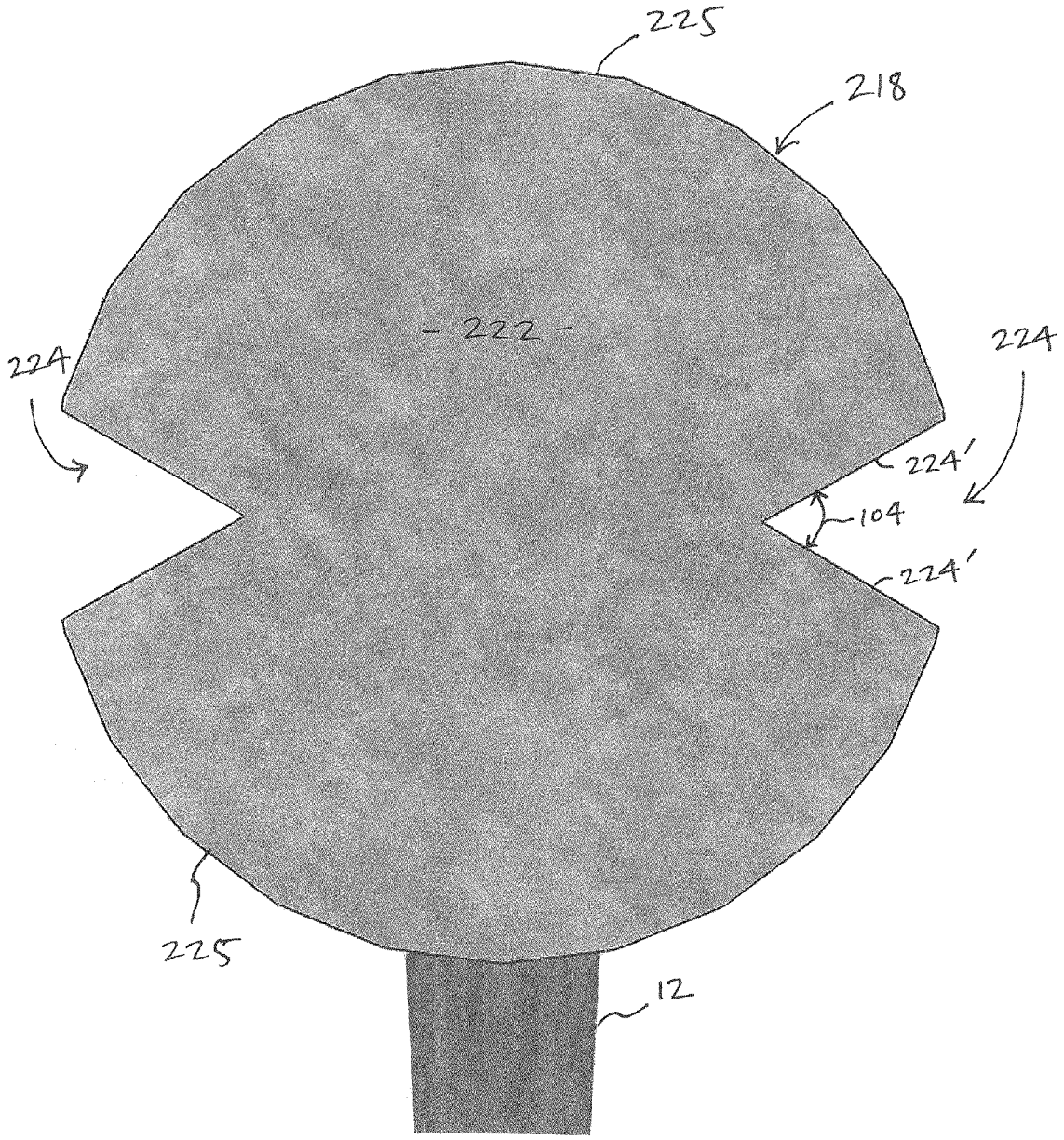
FIG. 8 is a front schematic representation similar to the embodiments of FIGS. 6 and 7 but intended for use with a differently dimensioned and shaped multi-sided mandrel.

As noted, the preferred embodiments of FIGS. 1-5 clearly represent the exposed, recessed surfaces 24, 124, having a curved and/or concaved configuration along at least a majority of the respective lengths thereof. In contrast, all or at least some of the plurality of recessed, exposed surfaces 224 are multi-sided to the extent that portions 224' thereof are disposed at predetermined angular orientations. As clearly represented in FIGS. 7 and 8, the angular spacing between the side segments 224' may vary so as to conform to the exterior surface configuration of the correspondingly dimensioned and configured multi-sided mandrel (not shown for purposes of clarity). In more specific terms, mandrels exist in the jewelry art which are multi-sided to the extent of being square, rectangular or a variety of other multi-sided exterior surface configurations. Accordingly, the embodiment of FIG. 6 comprises an angular spacing between the side segments 224' of be substantially 90°, as at 102. In contrast, the spacing may vary from the 90° of the embodiment of FIG. 7 as represented in FIG. 8. The angular spacing between the side segments 224' may be less than or greater than the 90° angle 102 of FIG. 7 as represented as 104 in FIG. 8.

Figure 6:
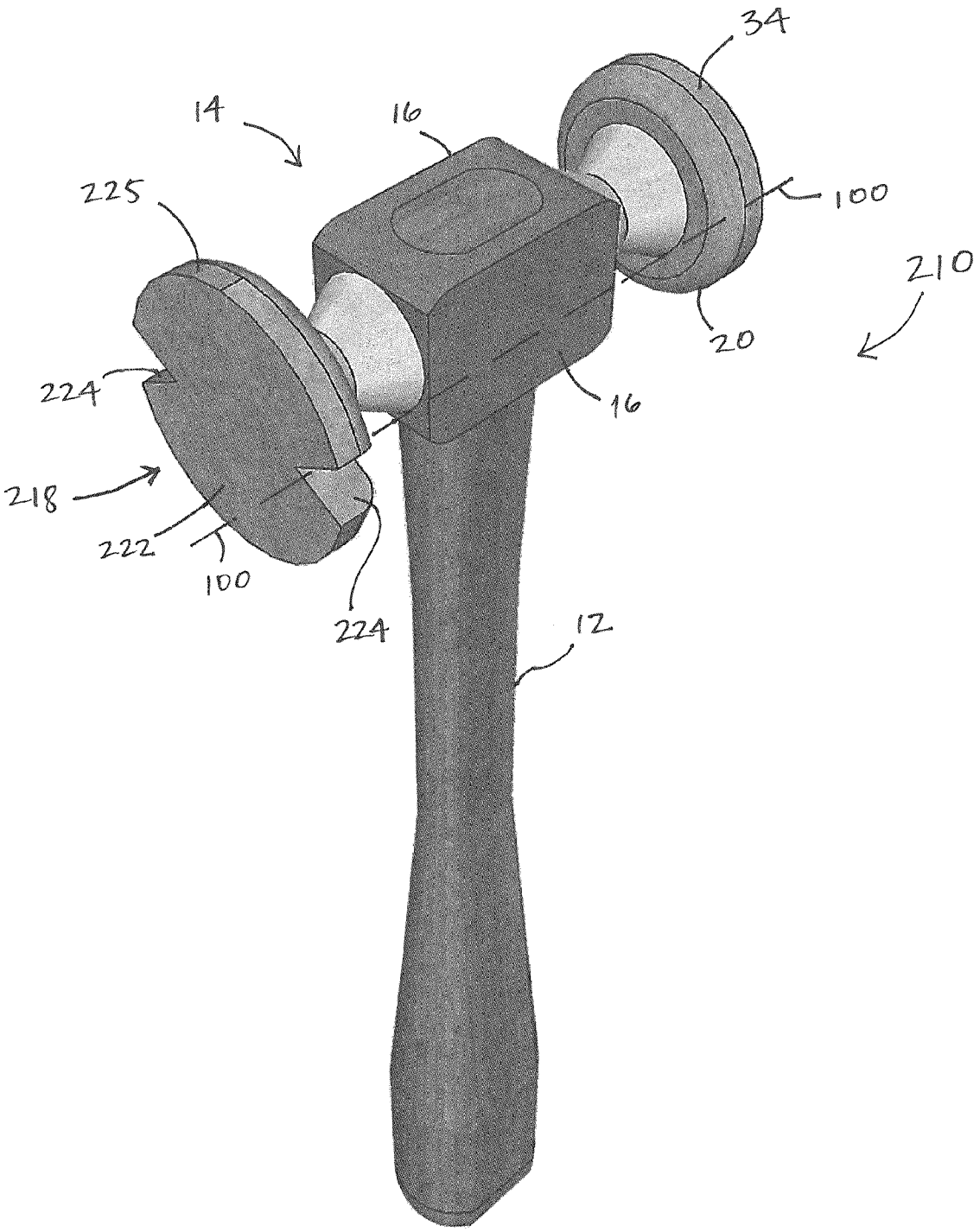
FIG. 6 is a perspective view of yet another preferred embodiment of the present invention intended to be used with the shaping of jewelry items in combination with a multi-sided mandrel.

As with the previously described embodiments, each of the plurality of at least two recesses 224 extend inwardly from and along the length of the outer periphery 225 of the striking member 218. As represented in FIG. 6, the head 14 of the shaping or striking tool 210 also includes the spaced, substantially opposing alignment member 20 having an outer periphery 34 at least a portion of which is disposed in aligned relation with the exposed, recess surface 224 as schematically represented as 100. As described with the above noted embodiments of FIGS. 1-5, the exterior periphery 34 and/or the corresponding surface thereof concurrently engages and slides along the length of a correspondingly dimensioned and configured multi-sided mandrel which conforms with the multi-sided configuration of the exposed, recessed surfaces 224 of either the embodiment of FIGS. 7 and 8.

Figure 9:
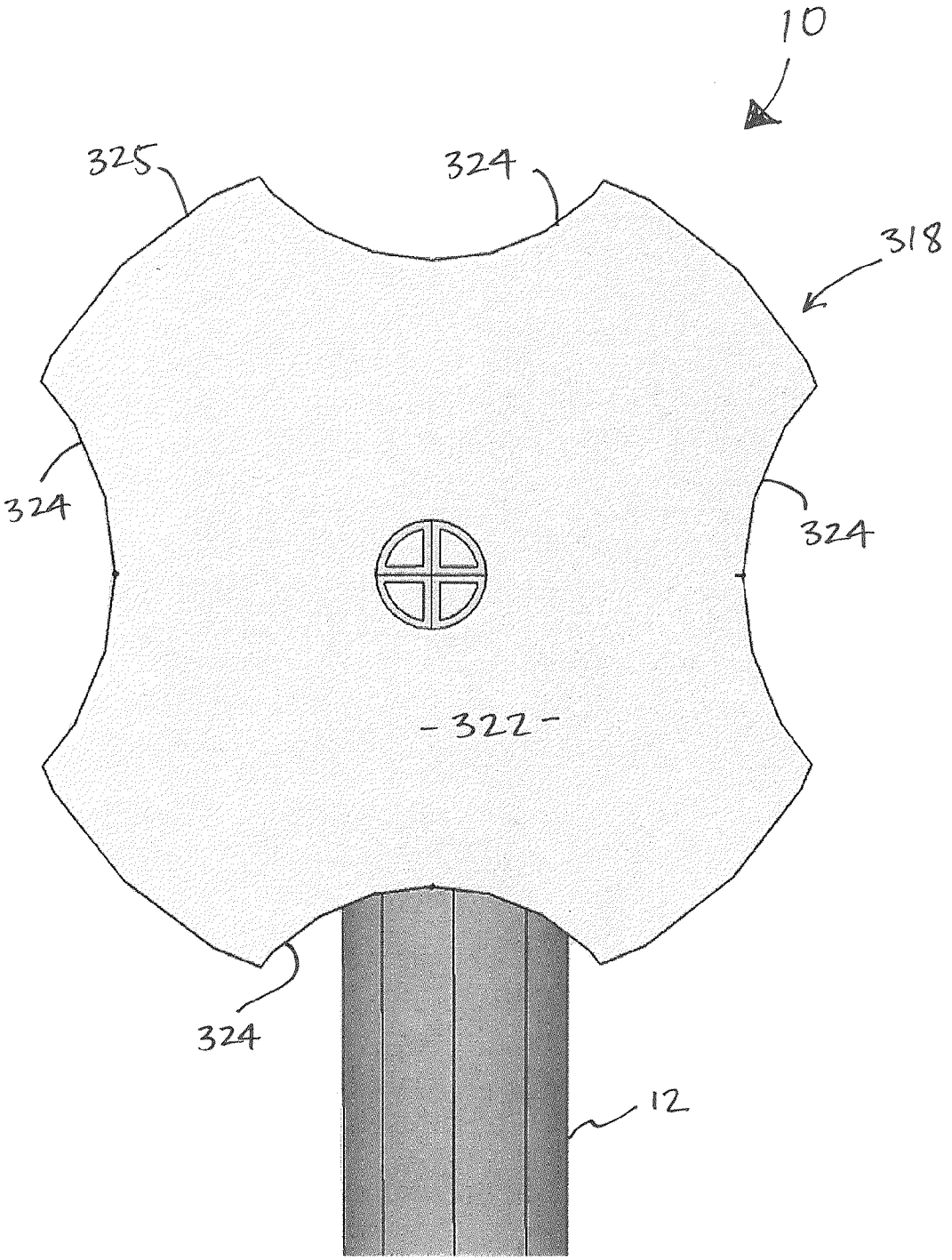
FIG. 9 is yet another preferred embodiment of the tool of the present invention similar to the embodiment of FIGS. 1-3 but differing in structure and operation.
Figure 10:
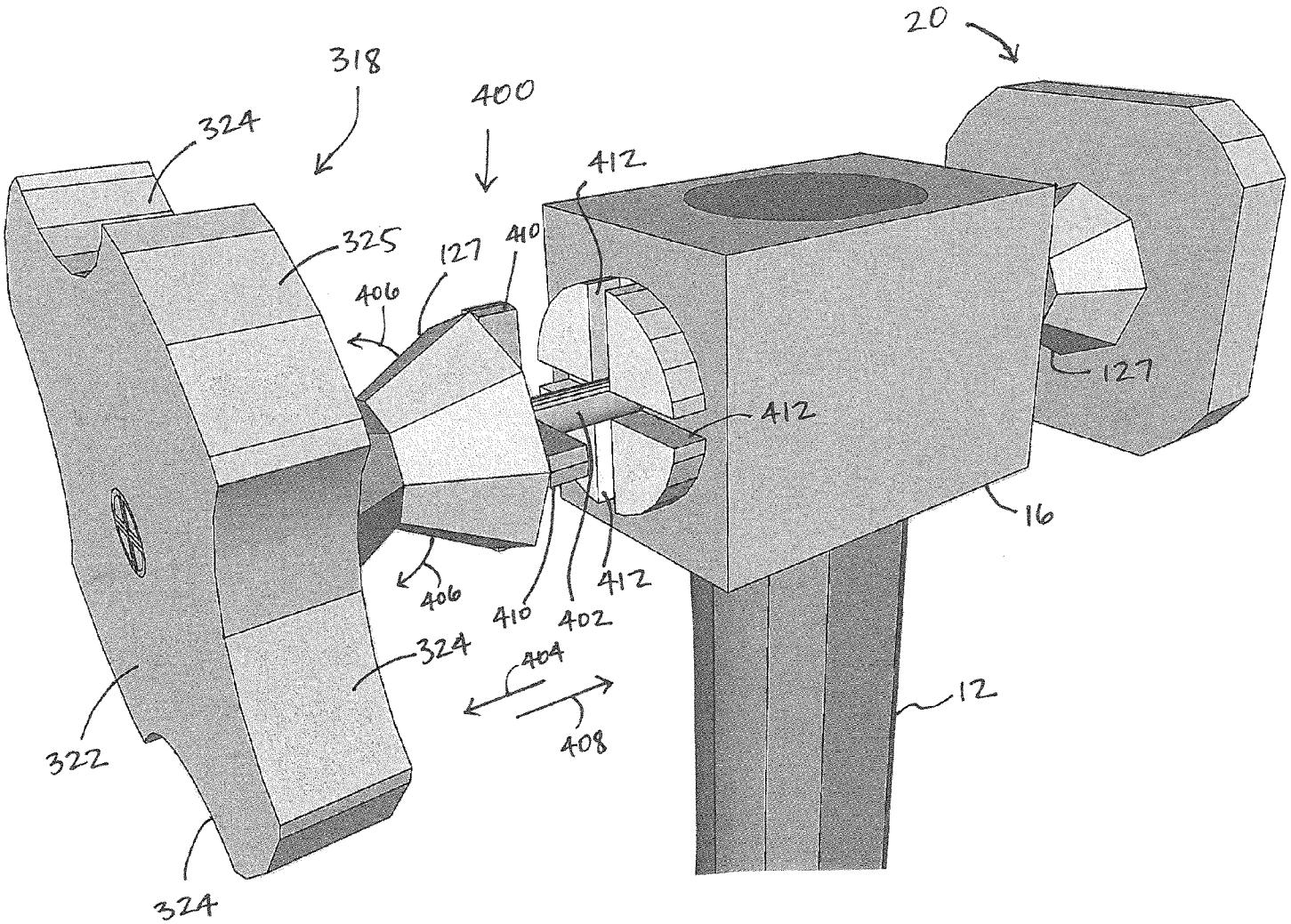
FIG. 10 is a perspective view in schematic form of yet another embodiment of the present invention representing different portions of the head being adjustably connected to the base portion of the head.
Figure 11:
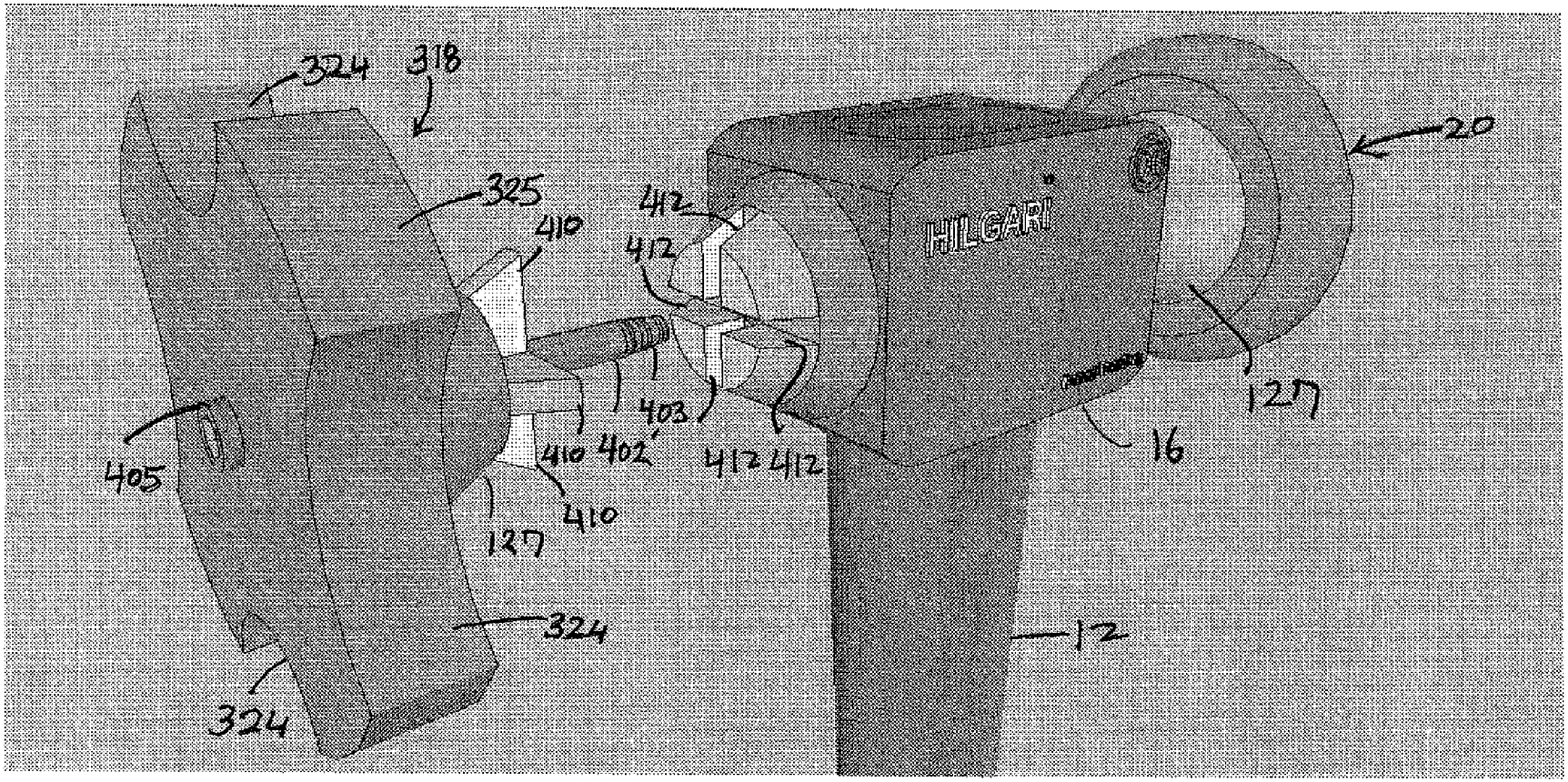
FIG. 11 is a perspective view of in schematic form of yet another embodiment of the present invention representing different portions of the head being removably connected to the base portion of the head.

Yet another preferred embodiment is represented in FIGS. 9 and 10 and includes the striking member 318 being connected to the base 16 in opposed relation to the alignment member 20. However, the striking member 318 includes a plurality of exposed, recessed surfaces 324 which are greater in number such as, but not limited to, four exposed, recessed surfaces 324. As with the above described embodiments of FIGS. 1-8, the plurality of exposed recessed surfaces 324 are disposed inwardly from and along the length the outer periphery 325. As such, the dimension and configuration of each of the recessed, exposed surfaces 324 substantially conforms to and slides along the length of a correspondingly dimensioned and configured mandrel (not shown in the embodiments of FIGS. 9 and 10). In addition, each or at least some of the plurality of recessed, exposed surfaces 324 may differ in longitudinal dimension and configuration. As a result, a user of the shaping or striking tool 10 of the embodiment of FIGS. 9 and 10 may selectively dispose appropriately sized and configured recesses 324 in an operative position to slidingly engage the exterior surface of a correspondingly dimensioned and configured mandrel of the type represented in FIGS. 3 and 5.

Further, in order to enhance the versatility of the shaping or striking tool 10 of the embodiment of FIGS. 9 and 10, at least the striking member 318 and/or both the striking member 318 and the alignment member 20 may be adjustably connected to the base 16 by a connecting assembly generally indicated as 400. As such, a connecting rod or finger 402 includes a distal end extending within the interior of the base 16 where it is connected to a biasing member such as a coil spring. The disposition and structuring of the biasing member, being attached to the distal end of the connecting rod 402, facilitates the outward positioning of the striking member 318, as schematically represented as at 404. When in such an outwardly spaced orientation represented in FIG. 10, the striking member 318 may be rotated in either of two opposite directions, as schematically indicated by directional arrows 406. Such rotation will position the intended or desired one of the plurality of recessed, exposed surfaces 324 in an operative position to slidingly engage the exterior surface of a correspondingly dimensioned and configured mandrel 30. When so positioned, the biasing spring disposed on the interior of the base 16 will then normally bias the striking member 318 back into a locked position, connected to the base 16, as at 408. Such a locking disposition may be accomplished by a plurality of keys 410 removably disposed in correspondingly dimensioned and configured key slots 412. As should be apparent the adjustable positioning and connection the striking member 318 to the base 16 can be easily accomplished by pulling out the striking member 318, as at 404, rotating the striking member 318 so as to properly dispose the intended or desired recess 324 into an operative position as at 406 and subsequently allow an inward disposition 408 of the striking member 318 back into connection with the base. Further, while only the embodiments of FIGS. 9 and 10 represent the adjustable connection of the striking member 318 to the base 16, it is emphasized that any of the above noted embodiments represented in FIGS. 1-8 may also include an adjustable connection of the respective striking members to the base 16 by incorporating an adjustable connecting assembly 400 or its structural and operative equivalent.

As set forth above, both the striking members 18, 118, 218, 318, etc. of each of the preferred embodiments, as well as the corresponding alignment members 20 thereof, may be removably connected to the base 16. Such removable connection is schematically represented in FIG. 11, wherein a connecting shaft, rod or finger 402' includes a threaded or other connecting exterior surface portion 403 which is dimensioned and structured to pass into the interior of the base 16 and therein be threaded or otherwise connect to an anchored nut or other securing member. This will allow both the respective striking member 318, etc. and/or corresponding alignment member 20 to be removably connected to the base 16 and be replaced, repaired, etc. Specific mounting or connection of the striking member 318 and/or alignment member 20 may be accomplished by passing the connecting rod or member 402' into the interior of the base 16 through an appropriately disposed aperture located at the junction of the transversely oriented key slots 412. Insertion of the rod 402' will be such as to allow the key members 410 to pass into and be received by corresponding key slots 412. When so positioned, an outer end 405 of the connecting rod or finger 402' may be rotated or otherwise manipulated manually or by an appropriate tool. This will accomplish rotation of the rod 402' and a mating engagement of the threaded or connecting exterior surface 403 with the anchored nut or other connecting member disposed within the base 16 as set forth above.

Figure 3A:
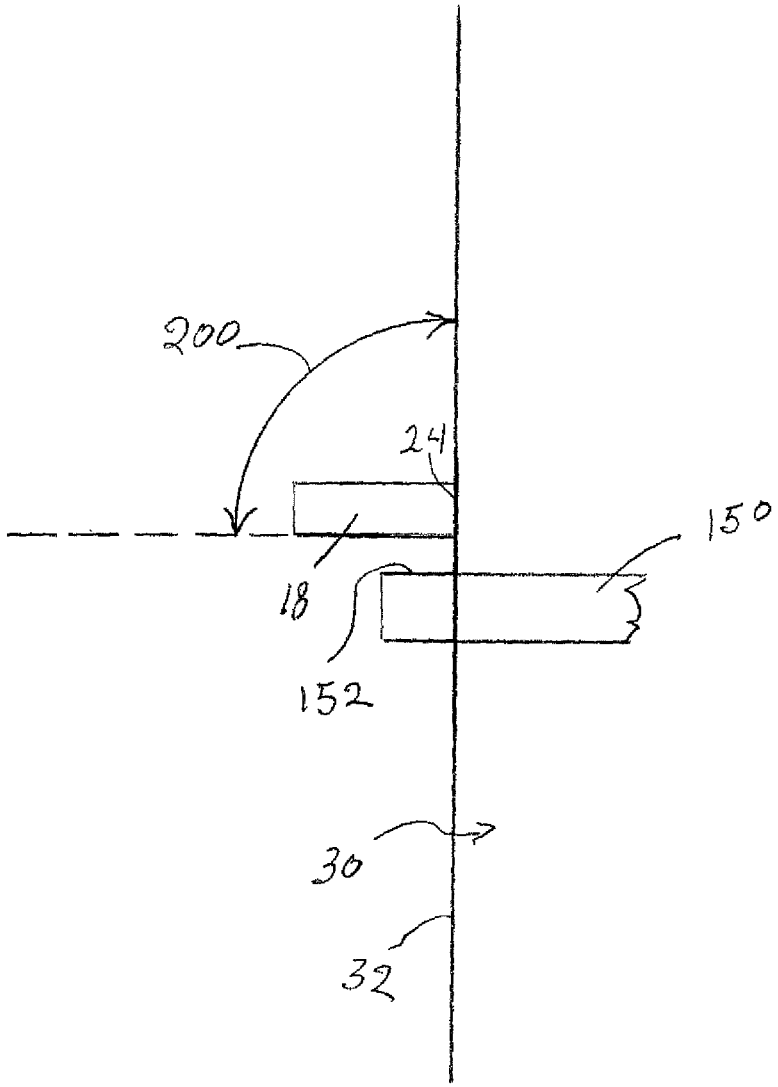
FIG. 3A is a schematic representation of the orientations of a striking surface of the tool of the present invention relative to a mandrel and a jewelry object thereon during the striking procedure of the tool on the jewelry object.

As represented throughout the Figures, it is emphasized that at least a majority of the length of a portion of the striking surface 22, which is disposed immediately adjacent and/or contiguous and in transverse relation to the corresponding recessed exposed surfaces 24, 124, 224, 324, etc. will engage the surface 152 of the jewelry object 150 being struck, as schematically represented in FIG. 3A. However, in order to enhance or increase the portion of the striking surface 22 which contacts the surface 152 being struck, the oppositely disposed ends 27 adjacent to the ends of the exposed recessed surfaces (see FIG. 1) may be selectively shaped. Such predetermined or selective shaping facilitates that substantially the entire length of the immediately adjacent or contiguous portion of the striking surface 22, relative to the exposed, recessed surface 24, will in fact engage the surface 152 of the jewelry object 150 being struck during the striking procedure. Such selective shaping, formation or orientation of the opposite ends 27 may include, but not be limited to, bending, tapering, extending and/or angularly orienting dependent at least in part of the dimension and shape of the jewelry object 150 being struck. In any event the selected and predetermined shaping of the ends 27 may accommodate the dimension and configuration of the mandrel 30, including the exterior surface 32 as well as the jewelry object 150 and the surface 152 being struck.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A striking tool structured to shape an object mounted on a mandrel, said striking tool comprising:

an elongated head having a longitudinal axis and including a base and a striking member connected to said base, wherein said base comprises the striking member on one end and an alignment member on an opposite end; an elongated handle attached to the base, the elongated handle having a longitudinal axis wherein the longitudinal axis of the handle is substantially perpendicular to the longitudinal axis of the head;

said striking member including a striking surface and a curved mandrel engaging portion, wherein said mandrel engaging portion comprises a mandrel engaging surface perpendicular to the striking surface and wherein the alignment member comprises an alignment surface perpendicular to the striking surface;

wherein a longitudinal axis runs tangential to the mandrel engaging surface and to the alignment surface with no obstructions between the mandrel engaging surface and the alignment surface, such that a straight mandrel surface may concurrently directly contact the mandrel engaging surface and the alignment surface; and said mandrel engaging surface disposed on said base is dimensioned and configured to movably engage the straight mandrel surface during a striking procedure of the striking surface on the object, and wherein said mandrel engaging surface is longitudinally dimensioned and configured to a transverse exterior surface dimension of the mandrel and disposed in inwardly recessed relation to an outer periphery of said striking member.

2. A striking tool as recited in claim 1, wherein said mandrel engaging surface comprises a curved configuration extending along at least a majority of its length, said curved configuration dimensioned to substantially conform to a portion of said mandrel surface being engaged by the mandrel engaging surface during said striking procedure.

3. A striking tool as recited in claim 2, wherein said mandrel engaging surface comprises a substantially concave configuration extending along at least a majority of its length.

4. A striking tool as recited in claim 1, wherein said mandrel engaging surface comprises a multi-sided configuration extending along at least a majority of its length; said multi-sided configuration dimensioned to substantially conform to said mandrel surface engaged by said mandrel engaging surface during said striking procedure.

5. A striking tool as recited in claim 1, wherein said striking member is removably connected to said head.

6. A striking tool structured to shape an object mounted on a mandrel, said striking tool comprising:

a head including a base and a striking member connected to said base, wherein said base comprises the striking member on one end and an alignment member on an opposite end;

said striking member including a striking surface and a mandrel engaging portion, wherein said mandrel engaging portion comprises a mandrel engaging surface perpendicular to the striking surface and wherein the alignment member comprises an alignment surface perpendicular to the striking surface;

wherein a longitudinal axis runs tangential to the mandrel engaging surface and to the alignment surface with no obstructions between the mandrel engaging surface and the alignment surface, such that a straight mandrel surface may concurrently directly contact the mandrel engaging surface and the alignment surface; and said mandrel engaging surface disposed on said base is dimensioned and configured to movably engage the straight mandrel surface during a striking procedure of the striking surface on the object, and wherein said mandrel engaging portion including a plurality of exposed surfaces each recessed inwardly from an outer periphery of said striking member; each of said exposed surfaces longitudinally dimensioned and configured to conform to and slidingly engage an exterior surface of a cooperatively dimensioned and configured mandrel on which the object is mounted, during said striking procedure.

7. A striking tool as recited in claim 6, wherein at least some of said plurality of exposed surfaces are dimensioned and configured to slidingly engage different sized mandrels.

8. A striking tool as recited in claim 6, when at least two of said plurality of exposed surfaces are disposed in opposed relation to one another along said periphery of said striking member.

9. A striking tool as recited in claim 7, wherein said striking member is adjustably disposed on said head to facilitate each of said plurality of exposed surfaces being independently disposable in engaging relation with a correspondingly dimensioned and configured mandrel, at least during said striking procedure.

10. A striking tool as recited in claim 6, wherein said plurality of exposed surfaces comprise a plurality of curved surfaces.

11. A striking tool as recited in claim 6, wherein said plurality of exposed surfaces comprise at least four exposed curved surfaces.

* * * * *